US005811229A

United States Patent [19]

Van den Zegel

[11] Patent Number: 5,811,229

[45] Date of Patent: Sep. 22, 1998

[54] RADIOGRAPHIC IMAGE FORMING FILM-SCREEN SYSTEM WITH BLUE PIGMENT

[75] Inventor: Marc Van den Zegel, Boortmeerbeek, Belgium

[73] Assignee: AGFA-Gevaert, N.V., Mortsel, Belgium

[21] Appl. No.: 787,379

[22] Filed: Jan. 22, 1997

[30] Foreign Application Priority Data

Feb. 19, 1996 [EP] European Pat. Off. ..... 96200417

[51] Int. Cl.[6] ..... G03C 1/825; G03C 5/17

[52] U.S. Cl. ..... 430/517; 430/139; 430/502; 430/965; 430/966

[58] Field of Search ..... 430/139, 502, 430/517, 966, 965

[56] References Cited

U.S. PATENT DOCUMENTS 3,705,807 12/1972 Busatto ..... 430/517
4,900,652 2/1990 Dickerson et al. ..... 430/966
5,213,951 5/1993 Delfino et al. ..... 430/966
5,252,443 10/1993 Dickerson ..... 430/966
5,468,599 11/1995 Biavasco et al. ..... 430/966

*Primary Examiner*—Richard L. Schilling
*Attorney, Agent, or Firm*—Breiner & Breiner

[57] ABSTRACT

An image-forming film-screen system for medical diagnostic imaging is disclosed comprising a light-sensitive silver halide photographic film material in operative association with at least one intensifying screen comprising on a support a layer of a visible light emitting luminescent phosphor, the said film material comprising a support and on at least one side thereof a light-sensitive silver halide emulsion layer having spectrally sensitized tabular silver halide and a non-light-sensitive protective layer, wherein said protective layer contains a polymeric compound selected from the group consisting of gelatin, a synthetic, semi-synthetic or natural substitute for gelatin and latex (co)polymers, in an amount of at least 0.4 g per $m^2$; characterized in that between a light-sensitive silver halide emulsion layer and said protective layer there is an intermediate layer comprising a blue colored pigment in dispersed form, having a solubility in isopropanol at 25° C. of less than 10 mg per liter.

10 Claims, No Drawings

RADIOGRAPHIC IMAGE FORMING FILM-SCREEN SYSTEM WITH BLUE PIGMENT

DESCRIPTION

Field of the Invention

This invention relates to a radiographic image forming screen-film system of at least one intensifying screen and a light-sensitive silver halide photographic material in operative association therewith.

Background of the Invention

In radiology classical screen-film systems still remain important. In a screen-film system phosphors present in an intensifying screen convert X-ray radiation into visible light. The photons of visible light emitted from said phosphors are then absorbed by adjacent radiographic film material containing light-sensitive silver halide emulsion crystals.

For applications, such as mammography and diagnosis of extremeties, where radiographic images having high sharpness are required, suitable screen-film systems usually contain only one screen. Light-sensitive silver halide photographic layer(s) coated at only one side of a film support are used in this application, wherein the outermost layer of said film should be in close contact with the said screen in favour of sharpness.

For general applications wherein a higher sensitivity is preferred red the screen-film system contains two screens. Between the said screens the film is positioned and comprises on each side of the support at least one light-sensitive silver halide photographic layer.

In the said light-sensitive layer tabular silver halide emulsion crystals are frequently used nowadays. Tabular grains are disclosed e.g. in U.S. Pat. No. 4,414,304 for their high covering power and developability and in U.S. Pat. Nos. 4,425,425 and 4,425,426 for their lower cross-over. All these effects are the result of a higher surface to volume ratio characteristic for said tabular grains.

Said higher surface to volume ratio also provides adsorption of higher amounts of spectral sensitizing dyes, offering the advantage of absorption of more incident light, thereby reducing cross-over.

One disadvantage however resulting from the presence of higher amounts of spectral sensitizing dye(s) is dye stain after processing, due to incomplete removal of said dye(s) from the processed material.

Another unacceptable disadvantage of tabular grains is the yellow-brown color of the developed silver after processing, especially when said grains have a thickness of less than 0.30 $\mu$m. For thinner tabular grains even a more tremendous deterioration from the desired black image tone is observed, especially when the image is examined in transparency as well as under reflected light conditions.

A solution for these problems has been described in e.g. EP-A 0 468 211 and in EP-A 0 655 645. Therein a blue colored pigment is added to the photographic sensitive layer or another layer of the film in order to reduce residual dye stain and to provide a black image tone. This blue pigment is characterized by an absorption maximum of from 570 to 630 nm and from 640 to 700 nm respectively. In the examples of EP-A's 0 468 211 and 0 655 645 this pigment is added to the light-sensitive emulsion layer containing silver halide emulsion crystals. Due to the presence of huge amounts of spectral sensitizers adsorbed at the large surface area of the tabular silver halide emulsion grains, dye stain is a serious problem, and, as has been established in EP-A 0 468 211, the presence of said blue pigment reduces the amount of water soluble iodide and bromide salts necessary to get formation of J-aggregates of the spectral sensitizers used in favour of reducing cross-over. As has further been described in that application the pigment must be insoluble in water and at least be insoluble in the solvent in which the pigments are used.

However the presence of a blue pigment in a photographic element in operative association with an intensifying screen enhances the risk of staining of the surface of said screen so that artefacts can occur on the image formed after contact with such stained screen. This phenomenon especially occurs after cleaning the screen surface with solvents used as screen-cleaners. As a consequence of frequent cleaning procedures it often happens that a stained screen is obtained that cannot be cleaned anymore.

Moreover blue pigment escaping from the film material often makes dirty the rollers in the automatic processing machine wherein the exposed film material is processed, thereby disturbing images generated on the following films processed therein.

Objects and Summary of the Invention

Therefore it is an object of the present invention to prevent staining of intensifying screens during exposure when used in operative association with radiographic film materials comprising blue pigments, incorporated therein to prevent dye staining by spectral sensitizers adsorbed at the surface of tabular silver halide emulsion grains present in light-sensitive emulsion layers of said film materials and/or to improve blackness of images (developed silver) resulting from developed tabular grains.

It is a further object of this invention to prevent staining of the rollers in automatic processing machines during processing said exposed materials. Other objects of this invention will become apparent from the description hereinafter.

Therefore an image-forming film-screen system for medical diagnostic imaging is disclosed comprising a light-sensitive silver halide photographic film material in operative association with at least one intensifying screen comprising on a support a layer of a visible light-emitting luminescent phosphor, the said film material comprising a support and on at least one side thereof a light-sensitive silver halide emulsion layer having spectrally sensitized tabular silver halide and a non-light-sensitive protective layer, wherein said protective layer contains a polymeric compound selected from the group consisting of gelatin, a synthetic, semi-synthetic or natural substitute for gelatin and latex (co)polymers, in an amount of at least 0.4 g per $m^2$; characterized in that between a light-sensitive silver halide emulsion layer and said protective layer there is an intermediate layer comprising a blue colored pigment in dispersed form, having a solubility in isopropanol at 25° C. of less than 10 mg per liter.

Detailed Description of the Invention

The best results to improve the color of silver generated from developed tabular silver halide grains present in light-sensitive layers of exposed radiographic film material used in the screen-film system according to this invention are obtained when the blue dye or pigment is present in an intermediate layer located between a light-sensitive silver halide emulsion layer situated farther than any other silver halide emulsion layer, if present, from the film support and a non-light-sensitive protective layer of a photographic material. Said protective layer corresponds with the protective antistress layer, whereupon in some applications an afterlayer may be coated.

It is necessary to use blue dyes having low solubility in isopropanol, in order to prevent dye staining of said screens. Isopropanol is normally used as a screen cleaner.

It is important that in this invention at least said protective antistress layer and, if present, said afterlayer, contains a polymeric compound in an amount of at least 0.2 g per $m^2$ and more preferably at least 0.4 $g/m^2$. Said protective antistress layer may be composed of two different layers, the layer more close to the support acting as an intermediate layer comprising said blue dye(s) in dispersed form. Said two different layers may have the same composition, except for the presence of said blue dye(s) in dispersed form.

In order to provide a film material applicable in rapid processing applications it is further important to have said polymeric compound in an amount of not more than 2 $g/m^2$, especially with regard to drying velocity.

According to this invention said polymeric compound is a compound selected from the group consisting of gelatin, a synthetic, semi-synthetic or natural substitute for gelatin, and latex (co)polymers. The presence of (additional) amounts of (natural or synthetic) clay and/or colloidal silica is further highly appreciated in favor of physical surface characteristics as such as glare, slidability, etc.

Gelatin is well-known as an essential polymeric compound of hydrophilic colloid layers in photographic materials. Synthetic substitutes for gelatin are e.g. polyvinyl alcohol, poly-N-vinyl pyrrolidone, polyvinyl imidazole, polyvinyl pyrazole, polyacrylamide, polyacrylic acid, and derivatives thereof, in particular copolymers thereof. Natural substitutes for gelatin are e.g. other proteins such as zein, albumin and casein, cellulose, saccharides, starch, and alginates. In general, the semi-synthetic substitutes for gelatin are modified natural products e.g. gelatin derivatives obtained by conversion of gelatin with alkylating or acylating agents or by grafting of polymerizable monomers on gelatin, and cellulose derivatives such as hydroxyalkyl cellulose, carboxymethyl cellulose, phthaloyl cellulose, and cellulose sulphates.

Gelatin can be lime-treated or acid-treated gelatin. The preparation of such gelatin types has been described in e.g. "The Science and Technology of Gelatin", edited by A. G. Ward and A. Courts, Academic Press 1977, page 295 and next pages. The gelatin can also be an enzyme-treated gelatin as described in Bull. Soc. Sci. Phot. Japan, No. 16, page 30 (1966).

Examples of said latex (co)polymers used in the film material used in the film-screen system according to this invention have been described in e.g. Research Disclosure 19551, Jul. 1980, in EP-A's 0 452 568; 0 534 006; 0 558 196 and 0 643 326; in U.S. Pat. Nos. 3,443,946; 3,589,908; 3,640,721; 4,476,218 and 4,810,624 and in JP-A 06 250 315. Especially preferred latex polymers are e.g. latex polymers comprising polyacrylic acid as described in JP-A 05 134 336 and in EP-A 0 644 456.

Clays set forth hereinbefore are disclosed e.g. in EP-A 0 644 454, wherein i.a. particular synthetic clays have been described, which are very suitable to reach good surface characteristics.

In a preferred embodiment colloidal silica as disclosed in e.g. EP-A 0 670 517 is added to the coating solution(s) of the protective antistress layer and/or to an afterlayer, if present.

In another embodiment gelatin-grafted polymer particles as disclosed e.g. in U.S. Pat. Nos. 5,393,650 and 5,426,020 or matte polymeric particles covalently bound to gelatin and colloidal silica as disclosed in U.S. Pat. No. 5,300,411 are added to the coating solution(s) of the protective antistress layer and/or to an afterlayer, if present. Said polymeric matting particles may be covered by a layer of colloidal inorganic particles as described in e.g. in U.S. Pat. Nos. 5,288,598 and 5,378,577. Organic polymer particles as described in e.g. U.S. Pat. Nos. 4,914,012 and 5,342,733 may also be added as well as matting agents described in e.g. JP-A 04 162 032. Lubricants may further be added as described e.g. in U.S. Pat. No. 4,766,059 and in JP-A 05 107 687.

In a preferred embodiment of this invention said blue colored pigment present in dispersed form in an intermediate layer between emulsion layer and protective layer has a maximum absorption in the visible wavelength region from 570 to 700 nm and more preferred in the visible wavelength region from 570 to 630 nm as especially green-emitting screens are preferred in the film-screen system according to this invention in favour of reduced cross-over and sharpness.

Preferred blue colored dyes are selected from the group consisting of phthalocyanine dyes and indanthron dyes as illustrated in the Examples hereinafter. It is clear that a mixture of blue colored pigments can be used, the proviso that at least one of these pigments has a maximum absorption in the visible range of the wave-length spectrum from 570 to 700 nm, and more preferred in the range from 570 to 630 nm, and that the solubility of said dyes is less than 10 mg per liter in isopropanol at 25° C. In principle pigments or dyes having a maximum absorption for said wavelength values fulfilling the solubility conditions set forth hereinbefore can additionally be added to the coating layers of the material as e.g. magenta colored dyes for use as "color correcting dyes".

According to this invention said blue pigment(s) is (are) present in an intermediate layer coated between an emulsion layer situated farther from the film support than any other emulsion layer, if present, and a protective antistress layer in an amount of from 1 $mg/m^2$ to 100 $mg/m^2$, and more preferably in an amount of from 1 $mg/m^2$ to 50 $mg/m^2$.

Said blue pigments are preferably dispersed by the methods described e.g. in EP-A 0 569 074 and in EP-Application No. 95202034, filed Jul. 24, 1995. Further dispersion techniques which may be applied have been described in e.g. EP-A's 0 552 646 and 0 595 821 and in U.S. Pat. No. 4,900,652. Preferred mean particle sizes of the dispersed pigments are not more than 2 $\mu$m, more preferably not more than 1 $\mu$m and most preferably not more than 0.5 $\mu$m.

By making use of said selected blue colored pigment(s) in the prescribed amounts in the intermediate layer or interlayer coated upon the emulsion layer farthest from the support, a solution is offered for the problems situated hereinbefore: a suitable black image tone is obtained for the processed spectrally sensitized silver halide tabular grains and there is no staining of the intensifying phosphor screens after making frequent contact with films comprising said blue colored pigments, even not after a cleaning procedure wherein organic solvents are used, particularly isopropanol. No staining is further observed on the rollers of automatic processing machines wherein said films are run after exposure.

According to this invention light-sensitive spectrally sensitized tabular silver halide grains are used in at least one emulsion layer, wherein said tabular grains have an aspect ratio of from 2 to 20, a thickness from 0.06 to 0.30 $\mu$m, more preferably from 0.08 to 0.22 $\mu$m and wherein said grains account for at least 50%, more preferably at least 70% and even more preferably at least 90% of the total projective area of all grains. In a more preferred embodiment aspect ratios of said tabular grains are from 5 to 20 and the said thickness of the grains is varying from 0.08 to 0.25 μm. A preferred variation coefficient of less than 0.30, more preferred less than 0.20 and still even more preferred from 0.10 to 0.15 is highly appreciated. Such low variation coefficient can be attained by application of methods described in e.g. U.S. Pat. Nos. 5,147,772; 5,147,773; 5,171,659; 5,210,013 and 5,215,879.

Silver halide compositions of said tabular grains can be silver bromide, silver bromoiodide, silver chloride, silver chlorobromide, silver chloroiodide or silver chlorobromoiodide. Halide ions may be divided homogeneously or heterogeneously over the grain volume, dependent on the preparation method used. Preparation methods for tabular grain emulsions have been described e.g. in EP-A 0 569 075 (in a gelatinous dispersing medium), in EP-A 0 677 773 (in colloidal silica) and in Research Disclosures 22534, January 1983; 232012, August 1983 and 36544, September 1994, i.a. in part I (Emulsion grains and their preparation). Coated amounts of silver in the silver halide emulsion layer(s) of the film material used in the system according to this invention are in the range from 2 to 6 $g/m^2$, and more preferably, from 3 to 5 $g/m^2$ and per side, expressed as an equivalent amount of silver nitrate.

Vehicles, vehicle extenders, vehicle-like addenda and vehicle related addenda which may be used in the context of this invention can be found in the same RD 36544, part II. Washing procedures for said emulsions can be applied as described in part III of the said RD. Emulsions coated in the film material used in the system according to this invention may be chemically sensitized as described in RD 36544, chapter IV.

According to this invention said light-sensitive tabular silver halide grains are spectrally sensitized to the blue or to the green region of the wavelength spectrum, the green region however being preferred. Spectral sensitizers used therefor have been described in RD 22534, January 1983, in RD 36544, chapter V, in EP-Application No. 95202096, filed Aug. 1, 1995, in EP-A's 0 752 034, 0 712 036, 0 712 034, 0 105 425, 0 144 091, 0 300 382, 0 487 010, 0 677 773 and 0 678 772 and in U.S. Pat. Nos. 4,942,121 and 5,108,887.

Development acceleration in order to enhance speed in the same processing cycle or in order to maintain speed in a shorter developing time can be accomplished by incorporating in the emulsion layer or adjacent layers various compounds, preferably polyoxyalkylene derivatives having a molecular weight of at least 400 such as those described in e.g. U.S. Pat. Nos. 3,038,805; 4,038,075 and 4,292,400 or development accelerators described in EP-A's 0 634 688 and 0 674 215.

UV absorbing dyes, optical brighteners and luminescent dyes can be used as described in RD 36544, chapter VI. Antifoggants and stabilizers can be used as described in the same RD, chapter VII. In Chapter VII of the said RD i.a. useful absorbing dyes, used as antihalation dyes are summarized. Further useful filter dyes have been described e.g. in EP-A's 0 656 401 and 0 724 191 and in EP-Application No. 93001438, filed Dec. 22, 1993.

Coating physical property modifying addenda like coating aids, plasticizers, lubricants, antistats and matting agents useful in the preparation of the coating solutions of the light-sensitive and non-light sensitive film layers are further described in RD 36544, chapter IX.

The gelatin binder of the radiographic film materials used in the system according to the present invention can be hardened with appropriate hardening agents such as those of the epoxide type, those of the ethylenimine type, those of the vinylsulfone type e.g. 1,3-vinylsulphonyl-2-propanol or di-(vinylsulphonyl)-methane, ethylene di-(vinyl-sulphone), vinylsulphonyl-ether compounds and vinylsulphonyl compounds having soluble groups, aldehydes like e.g. formaldehyde, glyoxal, and glutaric aldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binder can also be hardened with fast-reacting hardeners such as carbamoylpyridinium salts as disclosed in U.S. Pat. No. 4,063,952 and with the onium compounds as disclosed in EP-A 0 408 143. In order to get sufficiently hardened the binder should dispose of an acceptably high number of functional groups, which by reaction with an appropriate hardening agent can provide a sufficiently resistant layer. Such functional groups are especially amino groups, but also carboxylic groups, hydroxy groups, and active methylene groups.

In order to get a film material applicable in rapid processing applications it is necessary to have a film material that has been hardened to such an extent that a water absorption per gram of gelatin is not more than 3 g per gram of gelatin and even more preferred a water absorption of not more than 2 g per gram of gelatin. Said amount of water absorption is determined after incubating a sample of said film material at 57° C. and 34% RH for 3 days, weighing said sample, immersing it in distilled water at 21° C. for 3 minutes, squeezing it in order to get a surface free from water drops and weighing it again. Calculation of the differences in weight, divided by the surface area of the film strip and by the amount of gelatin coated per square meter gives the required value.

Another more suitable way to express the requirement to sufficiently harden the binder in the film material used in the screen-film system of this invention is to express it as a procentual swelling degree: the said procentual swelling degree, should not exceed a value of 300%, and more preferably should not exceed a value of 200%. Therefore after incubating a sample of a material at 57° C. and 34% RH for 3 days the thickness (a) of the layer assemblage is measured. Thereafter the sample is immersed in distilled water at 21° C. for 3 minutes and the thickness (b) of the swollen layer is measured.

The swelling ratio is then calculated as:

$$(b-a)/a\times 100\ (\%).$$

Layers and layer arrangements which can be applied to the film material in the system according to this invention are those described in EP-A's 0 752 617, 0 712 036, 0 712 034, 0 677 773, 0 678 772, 0 610 608; 0 610 609 and in EP-A 0 569 075, in U.S. Pat. Nos. 4,092,168 and 4,311,787; in DE 2,453,217 and in GB Patent 7,907,440.

Supports and subbing layers coated adjacent thereto, useful for the film materials in the system according to this invention, can be those as described in RD 36544, chapter XV, polyethylene naphthalate inclusive. For high speed processing applications a useful subbing layer is disclosed e.g. in JP-A 01 166 031. Vinylidene chloride and styrenebutadiene copolymers are the most well-known polymers for practical use as subbing layer ingredient in the film material of the screen-film system of this invention. Antistatic agents can be provided therein as e.g. in U.S. Pat. No. 5,391,472.

According to this invention a preferred screen in the screen-film system according to this invention is an intensifying screen comprising a green light-emitting luminescent phosphor, and more preferred a $Gd_2O_2S$:Tb luminescent phosphor.

In the system according to this invention a screen or a combination of screens can be used as has been described e.g. in EP-A's 0 592 724, 0 510 754, 0 647 258 and 0 648 254.

For double side coated film materials used in the system according to this invention it is clear that any combination of a symmetrical or asymmetrical film arrangement together with a symmetrical or asymmetrical pair of screens is useful. Herein the term "symmetrical or asymmetrical film arrangement" refers to film materials wherein sensitivity, gradation and/or spectral sensitivity is equal or not at opposite sides of the film support. Further the term "symmetrical or asymmetrical pair of screens" refers to screens wherein speed and/or spectral sensitivity is equal or not for both screens.

The photographic material containing spectrally sensitized tabular grains used in the system according to the present invention is image-wise exposed to visible light, preferably green light, generated from converted X-rays emitted by an X-ray source emitting X-rays with an energy adapted to the specific application. Conversion of X-rays proceeds by the preferred green light-emitting phosphors making part of the screens of the image forming film-screen system according to this invention.

Of course processing conditions and composition of processing solutions after image-wise exposure of the film material for use in the system according to this invention are dependent from the specific type of photographic material in which the spectrally sensitized tabular grains are applied. For example, in a preferred embodiment of materials for X-ray diagnostic purposes said materials are adapted to rapid processing conditions. Preferably an automatically operating processing apparatus is used provided with a system for automatic regeneration of the processing solutions. The forehardened material may be processed using one-part package chemistry or three-part package chemistry. Applications within total processing times of 30 seconds and even shorter up to processing times of 120 seconds, known as common praxis, are possible. From an ecological point of view it is even possible to use sodium thiosulphate instead of ammonium thiosulphate in the fixer solution. Useful processing compositions in the processing of films used in the system according to this invention have been described in EP-A 0 542 354, which is incorporated herein by reference.

The following examples illustrate the invention without however limiting it thereto.

EXAMPLES

1. Blue Colored Dyes: Trade Names and Structural Formulas

| DYE | MARKETED BY | TRADE NAME |
|---|---|---|
| A | ICI | Lutetia cyanine ENJPDR |
| B | BASF | Paliogenblau D6470 |
| C | Bayer | Macrolexblau RR |
| D | Hoechst AG | Reflex Blue 3G51 |
| E | Hoechst AG | Reflex Blue R54 |

2. Solubility of Blue Dyes

The solubility in mg/l (milligrams per liter) of dyes A-E was determined in water and in isopropanol (SOL.IP= solubility in isopropanol) at 25° C. by absorption spectroscopy. The accuracy with which said solubility was measured is about 10 mg/l.

| | SOLUBILITY | |
|---|---|---|
| DYE | water | isopropanol |
| A | <10 mg/l | <10 mg/l |
| B | <10 mg/l | <10 mg/l |
| C | <10 mg/l | 340 mg/l |
| D | <10 mg/l | 175 mg/l |
| E | 175 mg/l | 175 mg/l |

3. Preparation of the Dispersions of the Blue Colored Dyes 20 g of the blue colored dye powder (pigment) was dispersed at 45° C. in 200 g of an aqueous gelatin solution (8% by weight) by using a rotating pearl mill (Dynomill KD15) containing as a milling material zirconium oxide pearls having a size of 1.0 to 1.6 μm and 4 grams of Mersolat H76 Paste (trademarked product from Bayer AG, Leverkusen, Germany) were used as a dispering agent.

The milling procedure was stopped when a mean particle size of 0.6 μm was obtained.

4. Preparation Method of Double-side Coated X-ray Materials 4.1. Support 1 and 2

A blue dyed polyethylene terephthalate film support of 175 μm thickness was used. Support 1 had a specular density of 0.158 for white light, and support 2, containing a smaller amount of blue dye had a specular density of 0.118 for white light. Said specular density for white light was measured with a Mc Beth densitometer with diffuse geometry as described in ISO 5-2 and spectral response as described in ISO 5-3.

4.2. Subbing layer

At both sides of the film support a subbing layer was coated. This subbing procedure resulted in the following layer composition per $m^2$ and per side of said film support:

- 0.170 g of a latex copolymer of vinylidene chloride (88% by weight), methylacrylate (10% by weight) and itaconic acid (2% by weight),
- 0.06 g of a latex copolymer of methyl methacrylate (47.5% by weight), 1,3-butadiene (47.5% by weight) and itaconic acid (2% by weight),
- 0.001 g of poly methyl methacrylate-particles with an average diameter of 3.5 μm used as a matting agent,
- 0.003 g of Akypo OP 80 (trademarked product from Chemy) and 0.001 g of Hostapal BV (trademarked product from Hoechst AG) as coating aids.

4.3. Preparation of the coating solution of the light-sensitive emulsion layer 4.3.1. Preparation of AgBr(I) tabular grains A tabular silver bromoiodide emulsion, containing 1 mole % of AgI and 99 mole % of AgBr, was precipitated using the double jet technique. The excessive amount of soluble $KNO_3$ salt generated during precipitation of AgBr(I) crystals was removed by washing after emulsion flocculation following said precipitation. The crystals of the thus obtained tabular grain emulsion, containing 75 grams of gelatin per mole of $AgNO_3$, had the following characteristics tics, determined according to the method described in U.S. Pat. No. 4,414,304:

mean diameter of a circle with the same projective surface of the tabular grain: 1.12+/−0.23 μm (0.23 being the standard deviation s).

mean thickness of the tabular grains: 0.23 μm.

aspect-ratio: 5.5.

procentual part of the total projective surface of all grains present, covered by the tabular grains: 98%.

4.3.2. Chemical sensitization

This emulsion was chemically sensitized in the presence of anhydro-5,5'-dichloro-3,3'-bis(n.sulfobutyl)-9-ethyloxacarbocyanine hydroxide, chloro auric acid, sodium thiosulphate and potassium thiocyanate.

4.3.3. Preparation of the coating solution of the emulsion layer.

Per mole of $AgNO_3$ were added to the above described emulsion at 40° C.: 0.29 g of 4-hydroxy-6-methyl-1,3,3a,7-tetra-azaindene; 9.1 g of sorbitol; 14.5 g of poly ethyl acrylate (MW=1000000); 3.05 g of 1,3-dihydroxybenzene; 31 g of dextrane (MW=10000); 10 g of gelatin and demineralized water in an amount necessary to get an appropriate wet coating thickness.

4.4. Preparation of the coating solution of the intermediate layer.

To 800 ml of demineralized water were added: 44 g of gelatin and 44 g of a solution, 30% by weight, of KIESELSOL 300F (trademarketed product from Bayer AG, Leverkusen, Germany). Demineralized water was added to obtain the appropriate wet coating thickness and the desired amount of gelatin per $m^2$.

4.5. Preparation of the coating solution of the protective layer 1.

To 800 ml of demineralized water were added: 44 g of gelatin; 44 g of a solution (30% by weight) of KIESELSOL 300F (trademarketed by BAYER AG), 0.92 g of polymethylmethacrylate (average particle diameter : 3.5 μm); 0.3 g of ammoniumperfluorocaprylate and 10.8 g of a solution (37% by weight) of formaldehyde.

Demineralized water was added to obtain the appropriate wet coating thickness and the desired amount of gelatin per $m^2$.

4.6. Preparation of the coating solution of the protective layer 2.

To 800 ml of demineralized water were added: 44 g of gelatin; 44 g of a solution (30% by weight) of KIESELSOL 300F, 1.84 g of poly methyl methacrylate (average particle diameter: 3.5 μm); 0.6 g of ammoniumperfluorocaprylate and 21.6 g of a solution (37% by weight) of formaldehyde. Demineralized water was added to obtain the appropriate wet coating thickness and the desired amount of gelatin per $m^2$.

4.7. Coating method of the photographic materials

The materials were obtained by coating at 38° C., on the support provided with a subbing layer at both sides, the above described coating solutions for the emulsion layer, the intermediate and/or the protective (outermost antistress) layer respectively. Said materials were dried under controlled conditions of humidity and temperature, said temperature never exceeding 30° C. The emulsion layer, intermediate layer (if present) and protective layer were coated simultaneously by the slide hopper coating technique with the emulsion layer in direct contact with the subbing layer, the intermediate layer thereupon and as an outermost layer of the material the protective (antistress) layer. Before drying the thickness (known as "wet thickness") of the emulsion layer was 44 μm. Per $m^2$ and per side of the support the emulsion layer contained an amount of 3.8 g of AgBr(I), said amount being expressed as the equivalent amount of silver nitrate, and of 1.9 g of gelatin. The wet coating thickness and the gelatin content per $m^2$ of the protective and intermediate layers are given hereinafter in the description of the material compositions.

5. Evaluation Procedures 5.1. Determination of photographic sensitivity

Samples of the photographic materials were exposed using a continuous wedge with green light of 540 nm during 0.1 seconds and were processed in a 45 seconds cycle of a CURIX HT530 (Agfa-Gevaert trademarked name) processor.

Commercially available G138 developer and G334 fixer, both trademarked names from Agfa-Gevaert, were used as processing chemicals.

The density as a function of the light dose (log E) was then measured and the log E value at a density of 1.00 above fog was determined. This value was representing the sensitivity of the material. A more sensitive material has a lower log E value (requires a lower light dose).

5.2. Determination of fog

Unexposed samples were processed in the above described processing cycle. The specular density for white light was then determined. This fog thus includes the density of the blue dyes in the undercoat layer (support) and in the layers coated thereupon.

5.3. Determination of L, a*, b* of developed Ag

Samples of the materials were exposed in order to obtain the maximum density and were processed in the above described processing cycle. The color of the developed Ag, viewed by incident light was measured as CIELAB values: L, a*, b*.

Therefor a GRETAG spectrophotometer was used with 45°/0° measuring geometry, 20° standard observer and standard illuminant D65.

5.4. Determination of dye stain at the surface of the X-ray screen

The X-ray screen (format 24 cm×30 cm) was made slightly wet with Agfa-Gevaert Curix "screen-cleaner". This screen-cleaner mainly consists of isopropanol.

On the wetted X-ray screen, samples of the undeveloped photographic materials were placed. Thereupon a cardboard and a weight of 10 kg was placed during 2 hours.

The samples were then removed and the color of the X-ray screen was examined for appearance of dye stain. When dye stain was present, this X-ray screen was treated to be cleaned with the Curix "screen-cleaner". When the dye stain disappeared, the dye stain was called "cleanable".

The X-ray screen used in this dye stain test was CURIX ORTHO REGULAR 1FFJ5P (trademarketed screen by Agfa-Gevaert NV).

5.5. Contamination of the rollers of the Processing machine 800 sheets (format 14"×17") were processed in the above described processing cycle. The rollers of the racks of the fixer, of the rinsing and of the drying section were investigated for contamination and dye stain.

EXAMPLE 1

Example 1 shows the importance of the location of the blue colored dyes in the material. Therefore materials Nos. 1 to 4 were coated as follows:

Material No. 1 (comparison)

Material No. 1 was obtained by coating support 1 as described above with the coating solution of protective layer 1, coated at a wet thickness of 25 μm and at a gelatin content per $m^2$ and per side of the support of 1.1 g. No intermediate layer was coated.

Material No. 2 (comparison)

Material No. 2 was coated just as Material No. 1, except for the use of support 2 instead of support 1 as a support and for the addition of 4.1 g of a dispersion of dye A to the coating solution of the emulsion layer. The coated material contained 9.2 $mg/m^2$ and per side of dye A in the emulsion layer.

Material No. 3 (comparison)

Material No. 3 was coated as Material No. 2, except for the addition of 3.7 g of a dispersion of dye A which was added to the coating solution of the protective layer 1. This material thus contained 9.2 $mg/m^2$ and per side of dye A in the protective layer.

Material No. 4 (invention)

Material No. 4 comprises an intermediate layer coated at a wet thickness of 12.5 μm. Adjacent thereto and farther from the support the protective layer 2 was coated, also at a wet thickness of 12.5 μm. The gelatin content per $m^2$ of the intermediate and the protective layer was 0.55 g for both. An amount of 7.4 grams of a dispersion of dye A was added to the coating solution of the intermediate layer. This material thus contained 9.2 $mg/m^2$ and per side of dye A, said dye being located in the intermediate layer.

In Table I for the materials Nos. 1 to 4, No. 4 being coated according to this invention, data are summarized about La*b*-values, reflecting the color of the developed silver, together with values of fog (FOG), photographic sensitivity, presence (YES) or absence (NO) of a contamination of the rollers of the processing machine.

TABLE I

| MATL | dye location | FOG | Sensit. logE | L | a* | b* | contamination rollers |
|---|---|---|---|---|---|---|---|
| 1 | No dye | 0.173 | 1.75 | 17.30 | 1.77 | 4.14 | NO |
| 2 | emulsion layer | 0.171 | 1.95 | 16.89 | 1.62 | 4.01 | NO |
| 3 | protective layer | 0.167 | 1.73 | 16.86 | 0.73 | 2.78 | YES, blue dye stain |
| 4 | intermediate layer | 0.168 | 1.73 | 16.87 | 0.75 | 2.76 | NO |

From Table I it can be concluded that addition of the dispersion of dye A to the protective layer or to the intermediate layer results in a more neutral (black) image tone (lower value of b*) of developed silver without loss of the photographic speed or increase of the fog level. However addition of dye A to the protective layer results in an unwanted blue stain on the rollers of the fixer rack, which is not the case for the material of the invention (No. 4) wherein dye A is added to the intermediate layer.

EXAMPLE 2

Example 2 shows the necessity to use blue dyes having a low solubility in isopropanol. Therefore Materials Nos. 5 to 8 were additionally coated:

Material No. 5 was coated just as Material No. 4 except for the use of 10.8 g of a dispersion of dye B instead of dye A which was added to the coating solution of the intermediate layer. This material then contained 13.5 $mg/m^2$ of dye B per side of the support.

Material No. 6 was coated just as Material No. 4 except for the addition of 14.5 grams of a dispersion of dye C instead of dye A which was added to the coating solution of the intermediate layer. This material then contained 18.7 $mg/m^2$ of dye C per side of the support.

Material No. 7 was coated just as Material No. 4 except for the addition of 4.6 grams of a dispersion of dye D instead of dye A which was added to the coating solution of the intermediate layer. This material then contained 5.8 $mg/m^2$ of dye D per side of the support.

Material No. 8 was coated just as Material No. 4 except for the addition of 4.9 grams of a dispersion of dye E instead of dye A which was added to the coating solution of the intermediate layer. This material then contained 6.1 $mg/m^2$ of dye E per side of the support.

In Table II for the Materials Nos. 1 and 4–8 which were coated as described hereinbefore data are summarized about La*b*-values, reflecting the color of the developed silver, together with values of fog (FOG), coated amount of dye (DYE) in the intermediate layer and with data for the solubility in isopropanol (SOL.IP), expressed in mg/l, of the corresponding dye.

Materials Nos. 4 and 5 were coated according to this invention.

TABLE II

| MATL | DYE | SOL.IP (mg/l) | FOG | L | a* | b* | Screen stain |
|---|---|---|---|---|---|---|---|
| 1 (comparison) | — | — | 0.173 | 17.30 | 1.77 | 4.14 | No |
| 4 (invention) | A | <10 | 0.168 | 16.87 | 0.75 | 2.76 | No |
| 5 (invention) | B | <10 | 0.172 | 16.45 | 1.41 | 3.24 | No |
| 6 (comparison) | C | 340 | 0.172 | 16.44 | 1.11 | 2.91 | Yes** |
| 7 (comparison) | D | 175 | 0.172 | 16.41 | 0.84 | 3.02 | Yes** |
| 8 (comparison) | E | 175 | 0.180 | 16.70 | 1.18 | 2.74 | Yes** |

**not cleanable X-ray screen

As can be concluded from Table II the addition of a dispersion of a blue dye to the intermediate layer results in a more neutral (black) image tone (lower value of b*) of the developed silver, generated from tabular grain emulsions, after examination of said developed silver under reflected light conditions.

Further comparative materials coated from dyes, showing a high solubility in isopropanol, are characterized by an unremovable dye staining of the screens held in contact therewith, whereas materials having a composition according to this invention and thus coated with dyes showing a low solubility in isopropanol, are characterized by the absence of dye staining at the surface of intensifying screens.

I claim:

1. Image forming film-screen system for medical diagnostic imaging comprising a light-sensitive silver halide photographic film material in operative association with at least one intensifying screen comprising on a support a layer of a visible light emitting luminescent phosphor, the said film material comprising a support and on at least one side thereof a light-sensitive silver halide emulsion layer having spectrally sensitized tabular silver halide and a non-light-sensitive protective layer, wherein said protective layer contains a polymeric compound selected from the group consisting of gelatin, a synthetic, semi-synthetic or natural substitute for gelatin and latex (co)polymers, in an amount of at least 0.4 g per $m^2$; characterized in that between a light-sensitive silver halide emulsion layer and said protective layer on the same side of the support as the said protective layer there is an intermediate layer comprising a blue colored pigment in dispersed form, having a solubility in isopropanol at 25° C. of less than 10 mg per liter.

2. System according to claim 1, wherein said blue colored pigment in dispersed form has a maximum absorption in the visible wavelength region from 570 to 700 nm.

3. System according to claim 1, wherein said blue colored pigment in dispersed form has a maximum absorption in the visible wavelength region from 570 to 630 nm.

4. System according to claim 1, wherein said blue colored pigment is a pigment or dye selected from the group consisting of phthalocyanine dyes and indanthron dyes.

5. System according to claim 1, wherein said blue pigment is present in said intermediate layer in an amount of from 1 $mg/m^2$ to 100 $mg/m^2$.

6. System according to claim 1, wherein an average mean particle size of said blue colored pigment in dispersed form is not more than 0.5 $\mu$m.

7. System according to claim 1, wherein said light-sensitive tabular silver halide grains have an aspect ratio of from 2 to 20, a thickness from 0.06 to 0.30 $\mu$m and account for at least 50% of the total projective area of all grains and are spectrally sensitized to the green region of the wavelength spectrum.

8. System according to claim 1, wherein said screen is an intensifying screen comprising at least one green light-emitting luminescent phosphor.

9. System according to claim 8, wherein said green light-emitting luminescent phosphor is a $Gd_2O_2S$:Tb phosphor.

10. Light-sensitive silver halide photographic film material as defined in claim 1.

* * * * *